United States Patent [19]

Handa

[11] 4,142,851

[45] Mar. 6, 1979

[54] APPARATUS FOR PREVENTING GAS LEAKAGE

[76] Inventor: Rikiya Handa, 61-10, Bessho-machi Omiya-shi, Saitama-ken, Japan

[21] Appl. No.: 797,856

[22] Filed: May 17, 1977

[30] Foreign Application Priority Data

Dec. 30, 1976 [JP] Japan ..... 51-158924

[51] Int. Cl.[2] ..... F23N 5/24

[52] U.S. Cl. ..... 431/16; 431/22; 431/48; 431/89

[58] Field of Search ..... 431/16, 22, 89, 48; 137/487.5

[56] References Cited

U.S. PATENT DOCUMENTS

| | | | |
|---|---|---|---|
| 2,120,053 | 6/1938 | Fehrehbach | 431/16 |
| 2,800,176 | 7/1957 | Morrison | 431/89 |
| 3,744,954 | 7/1973 | Faulkner | 431/22 |

*Primary Examiner*—Carroll B. Dority, Jr.
*Attorney, Agent, or Firm*—Wenderoth, Lind & Ponack

[57] ABSTRACT

The present invention is an apparatus for preventing gas leakage from gas burning equipment, which comprises an electromagnetic valve which normally closes the gas passage near the gas supplying source, a gas pressure detector for measuring the gas pressure in the gas passage to detect a defect in the piping, at least one gas burning system having electrical circuits for detecting gas leakage other than that caused by defects in the piping, and a control panel for receiving all of the detection results to control the actuation of the electromagnetic valve and to issue an alarm signal, whereby the gas supply is interrupted when nonburning gas escapes from at least one piece of gas burning equipment which is in use and the alarm signal based on a fault or defect in the piping is issued when the gas escapes during a time that all of the gas burning equipment is kept in a non-use condition.

8 Claims, 6 Drawing Figures

APPARATUS FOR PREVENTING GAS LEAKAGE

The present invention relates to an apparatus for preventing gas leakage and, more particularly, to an apparatus for detecting gas leakage from gas burning equipment and producing an alarm where gas leakage is detected.

Hitherto, various apparatuses for preventing gas leakage have been proposed. One of these types of known apparatuses is a safety device for gas burning equipment which is actuated by ignition gas while opening a gas valve through the operation of a push button or the like, maintains the valve in an open state throughout the burning period by electromagnetically attracting the valve with an electromotive force controlled by a thermocouple and then releases the valve to close the gas passage when the flame of the gas burning equipment is extinguished. However, this type safety device is usually used for each piece of gas burning equipment and thus a plurality of such devices will be required for mounting them to each cooking furnace or heater, water boiler, bath burner, gas heater or the like. It is to be noted that this type safety device has a serious disadvantage in that the device has no effect other than on gas leakage in the gas equipment and, in other words, excepting the gas leakage due to extinguishment of the flame and thus is useless for gas leakages having other causes such as partial burning, defects in the piping or the like. As another type apparatus, a gas leakage alarm is also known. This latter type apparatus is for detecting leaking gas to issue an alarm signal and thus has a relatively low reliability, since its detecting ability is often influenced by various external conditions such as wind and the properties of the gas, for instance specific gravity, diffusability and others.

Therefore, a principal object of the present invention is to provide an apparatus for preventing gas leakage for gas burning equipment, which obviates and overcomes the disadvantages encountered in the conventional apparatuses as referred to.

A specific object of the present invention is to provide a highly reliable apparatus for preventing gas leakage from gas burning equipment, which is not influenced by various external conditions such as wind, properties of the gas and the like and which operates together with a gas supplying system.

Another object of the present invention is to provide an apparatus for preventing gas leakage from gas burning equipment, which has a simple structure, can be constructed at a relatively low cost and may be used for collectively controlling a plurality of pieces of gas burning equipment.

Still another object of the present invention is to provide an apparatus for preventing gas leakage, which can be mounted to a free end of a stationary pipe used as a gas supplying source, whereby any gas leakage occurring downstream, for instance, due to a crack, breakage and the like in a flexible hose can be detected, in addition to the gas leakage in one or more pieces of gas burning equipment.

Still other objects of the present invention and advantages to be attained by the present invention will become apparent by reading and fully understanding the following explanations.

Briefly speaking, the present invention relates to an apparatus for preventing gas leakage, which does not permit the flow of gas for purposes other than that for burning the same and which interrupts the gas supply when non-burning gas flows out of or escapes from at least one of the pieces of gas burning equipment which are in use and will issue an alarm signal upon detection of a fault or inferiority in a flexible hose when the gas leaks out while the gas burning equipment is kept in a non-use condition. According to the present invention, an electromagnetic valve is arranged near the gas supplying source, for instance at a free end of a stationary pipe of the gas supplying source. This electromagnetic valve normally closes the gas supplying passage to shut down any gas flow toward the gas burning equipment but is actuated to open the gas supplying passage, when an actuating signal to be referred to hereinafter closes an electric circuit for actuating the valve. This signal for actuating the valve is a combined signal from electrical detections of opening of each valve for each piece of gas burning equipment and of the burning of gas in each gas burning equipment. A pair of switches, the electric circuits of which are closed by closing the valve to the burning equipment and a burning sensitive mechanism, the electric circuit of which is closed by detecting the burning of gas in the burning equipment are provided for each gas burning system. One of the switches of each gas burning system is connected in turn in series to form a circuit, so that a closed circuit shows the either the gas is going to be consumed or gas is being consumed and an open circuit shows that the gas has not been consumed. The other switch and the burning sensitive mechanism for each gas burning system are also connected in turn in series and further output ends of the switch and burning sensitive mechanism in each gas burning installation are connected with each other to form another circuit. This circuit is closed at switch-side when the valve for each piece of gas burning equipment is closed and the burning of the gas does not occur, while the circuit is closed at the burning sensitive mechanism-side when the valve for each piece of gas burning equipment is open and the burning of the gas does occur, but the circuit is opened when the valve of at least one of the pieces of burning equipment is opened but the burning of gas does not occur that is the burning sensitive mechanism detects an abnormal or serious non-burning of gas.

According to the present invention, therefore, the signals to be produced by both such detectors are combined and arranged and then fed to the circuit for actuating and controlling the electromagnetic valve. Downstream of the electromagnetic valve, there is provided a gas pressure detector which opens or closes an electric circuit by detecting a change of the gas pressure. When the gas pressure in a flexible hose drops down to a value lower than a predetermined level when none of the gas burning equipment is used, the detector is actuated to close the circuit for operating an alarm member to issue a warning of the fault or inferiority of the flexible hose.

The invention will now be further explained with reference to an embodiment of the apparatus for preventing gas leakage, shown, by way of example only, in the accompanying drawings, in which.

Figure 1:
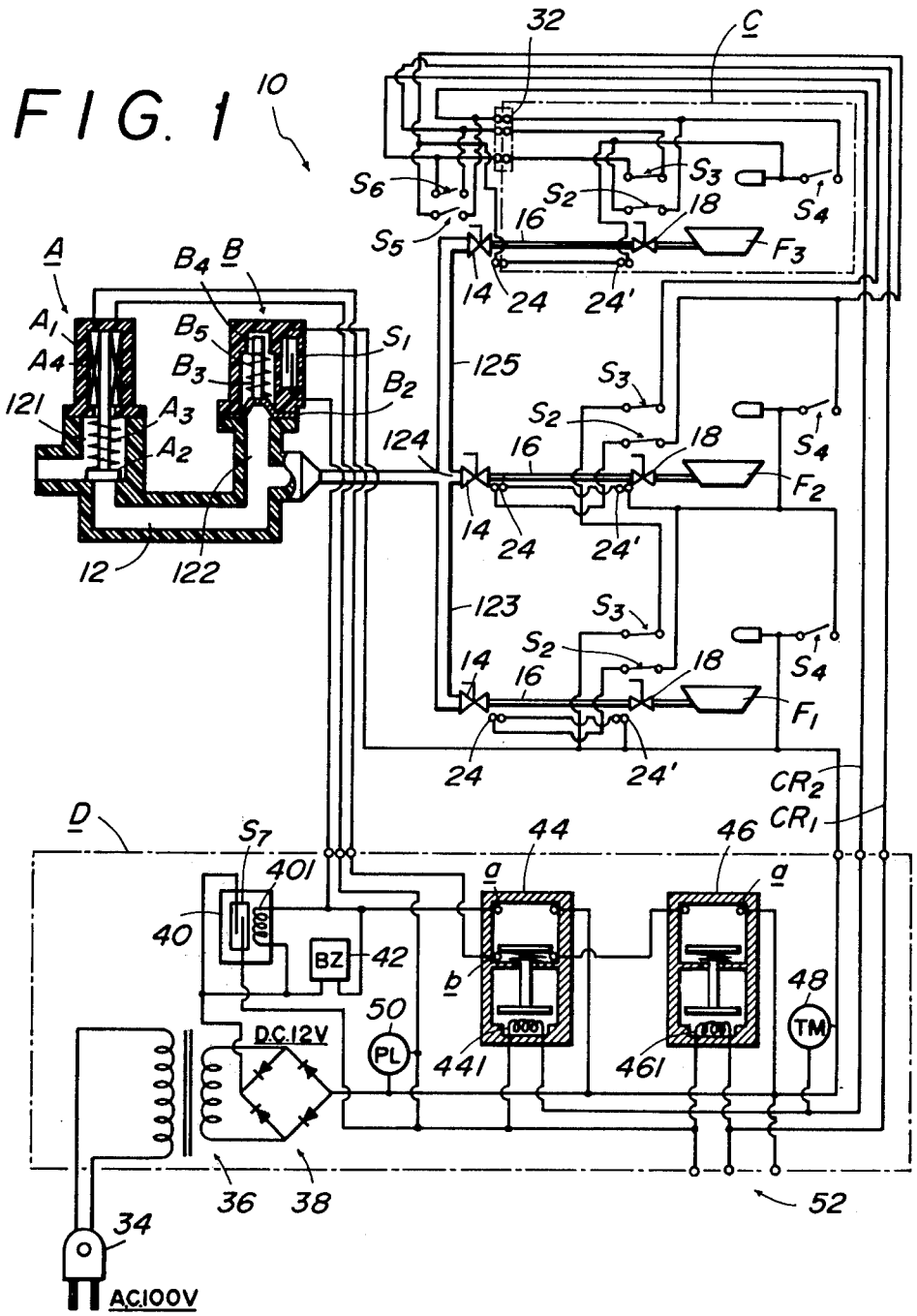
FIG. 1 is a circuit diagram showing an embodiment of an apparatus for preventing gas leakage according to the present invention, some parts of which are shown in section.

Referring now to FIG. 1 of the drawings, there is shown an embodiment of an apparatus for preventing gas leakage from gas burning equipment, according to the present invention. The apparatus 10 comprises essentially an electromagnetic valve A, a gas pressure detector B, at least one gas burning system C, each of which can be installed at a desired position and has gas burning equipment $F_1$, $F_2$ or $F_3$, and a control panel D.

The electromagnetic valve A and gas pressure detector B are mounted, respectively, on branched short pipe portions 121, 122 of a connecting pipe 12 which connects a stationary gas supplying source pipe (not shown) to the gas burning systems C. The electromagnetic valve A has a housing $A_1$ securely mounted to the pipe portion 121, a valve body $A_2$ accommodated in the housing $A_1$ which normally closes the gas passage in the connecting pipe 12 by an action of a coil spring $A_3$, and a solenoid $A_4$ which is also accommodated in the housing $A_1$ and is actuated to electromagnetically attract the valve body $A_2$ against the force of the spring $A_3$ so as to open the gas passage. The gas pressure detector B has a housing $B_1$ securely mounted to the pipe portion 122 which is arranged downstream of the electromagnetic valve A, a diaphragm $B_2$, one side of which is exposed to the gas so as to detect the pressure of the gas passing through the connecting pipe 12, a rod $B_3$ connected to the reverse side of the diaphragm $B_2$, a magnet $B_4$ secured to the free end of the rod $B_3$, a coil spring $B_5$ to press the diaphragm $B_2$ toward the gas passage, and a reed relay or switch $S_1$ which is normally opened but closed by the action of the magnet $B_4$ when the gas pressure in the gas passage drops below a predetermined level causing displacement of the rod $B_3$.

Downstream of the gas pressure detector B, the connecting pipe 12 may be branched, so that two or more gas burning systems C can be connected to these branched pipes. In FIG. 1, there are shown 3 branched pipes 123, 124, 125, each of which has a gas valve 14 at the free end thereof.

Each gas burning system C comprises a flexible hose 16, one end of which is connected to the gas valve 14 and the gas burning equipment $F_1$, $F_2$ or $F_3$ with a valve 18 which is connected to the other end of the flexible hose 16. Each of the gas burning systems C are provided with switches $S_2$, $S_3$ which are closed to form a detection circuit, when the corresponding valve 18 is closed to stop the gas supply for its gas burning equipment and burning sensitive member $S_4$ which is closed to form a detection circuit, when it detects the burning of gas in its gas burning equipment.

Figure 2:
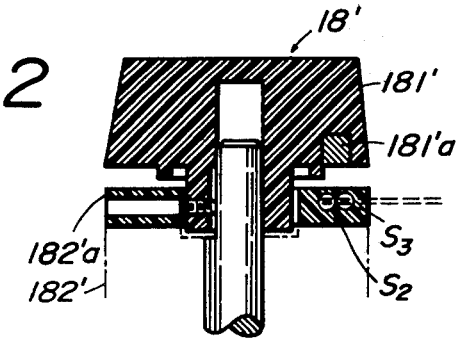
FIG. 2 is a sectional view showing an essential part of the valve portion of a piece of gas burning equipment.
Figure 3:
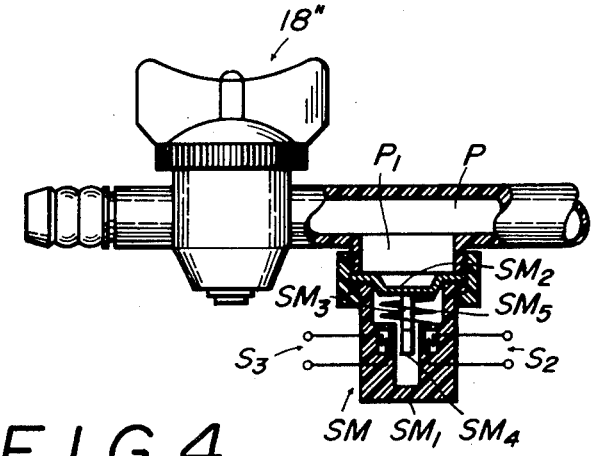
FIG. 3 is a fragmental partial view showing another type valve portion.

The relation between the switches $S_2$, $S_3$ and the valve 18 will be explained concretely with reference to FIGS. 2 and 3 which illustrate two embodiments. In FIG. 2, a valve 18' has a finger lever 181' having a magnet piece **181'*a* embeded therein and a body 182' having a base plate 182'*a* secured thereto, which has reed relay switches $S_2$ and $S_3$ embeded in the base plate 182'*a*, so that the switches $S_2$ and $S_3$ are opened or closed by turning the finger 181'. In FIG. 3, a valve 18" and a switch mechanism SM are separately formed and made integral with each other by a pipe P. In this embodiment, the switch mechanism SM is formed in a manner similar to the gas pressure detector B (FIG. 1) and comprises a housing $SM_1$ mounted on the pipe P through a branched short connecting pipe $P_1$, a diaphragm $SM_2$, one side of which is exposed to the gas of the pipe P through the connecting pipe $P_1$, a rod $SM_3$ connected to the reverse side of the diaphragm $SM_2$, a magnet $SM_4$ secured to the free end of the rod $SM_3$, a coil spring $SM_5$ to press the diaphragm $SM_2$ toward the gas passage, and reed relays or switches $S_2$ and $S_3$ which are arranged close to the rod $SM_3$, so that the switches $S_2$, $S_3$ are normally kept in an open state but closed by the action of the magnet $SM_4$ when the gas pressure in the gas passage drops down below a predetermined level. Although two embodiments as shown in FIGS. 2 and 3 have been explained hereinabove, conventional switches which operate by mechanical transmission of the finger movement of the valve 18** may be employed, but it preferable to construct the switches as the sealed switches shown in the figures so as to prevent possible insulation or contacting problems.

Figure 6:
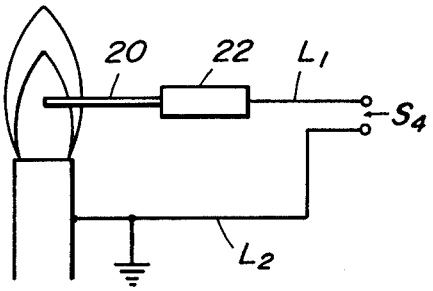
FIG. 6 is an illustration showing a mechanism for detecting burning in a piece of gas burning equipment.

A thermocouple may be employed as the burning sensitive member $S_4$ (FIG. 1). The electromotive force of the thermocouple is amplified to close or open the detecting circuit. The circuit as shown in FIG. 6 may be used as an alternative circuit for the burning sensitive member $S_4$. In the circuit as shown in FIG. 6, the burning sensitive switch $S_4$ is arranged between a line $L_1$ having an electrode 20 and an insulator 22, a free end of electrode 20 being arranged to contact the possible burning flame and another line $L_2$ which is grounded. Switch $S_4$ is closed or opened in response to the conductivity change due to the presence or absence of the burning flame using a conventional technique, for instance by applying the signal of the conductivity change to the gate of a field effect transistor (not shown).

Figure 4:
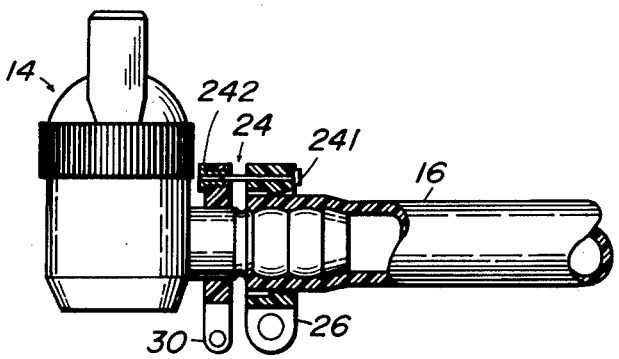
FIG. 4 is a partial sectional and partial fragmental illustration showing a portion for connecting a flexible hose to a gas plug connected to a stationary connecting pipe which is, in turn, to be connected to a stationary gas supplying pipe.
Figure 5:
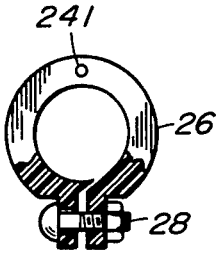
FIG. 5 is a partial fragmental illustration showing a clamping ring for safely fitting a flexible hose to the gas plug.

The switches $S_3$ for each of the burning system C are subsequently connected with one another in series to form a circuit $CR_1$ which is closed only when all of the valves 18 are kept in the closed state. By checking the circuit $CR_1$, therefore, one can confirm whether any gas has been consumed or gas is consumed in at least one piece of the gas burning equipment. In the embodiment as shown in FIG. 1, the circuit $CR_1$ has two further contacts 24 and 24' for each piece of gas burning equipment, these contacts being arranged in series and normally kept in closed state but opened when the associated flexible hose 16 is detached from the gas valve 14 or valve 18. The provision of the contacts 24, and 24' makes it possible to detect the removal of at least one of the flexible hoses 16 whether the corresponding valve 18 is opened or the gas supplied to the corresponding gas burning equipment escapes therefrom without burning. The contacts 24 and 24' are substantially the same and thus the structure of the former shall be explained hereinafter in more detail with reference to FIGS. 4 and 5. As seen from the figures, the contact 24 is formed by two contact pieces 241 and 242. The first contact piece 241 is a pin-like member secured to or inserted into a coupling or clamping ring 26 to be mounted on the free end of the flexible hose 16 with use of a screw-nut assembly 28. The second contact piece 242 is a pin-planted ring secured to a clamping ring 30 which is mounted on the valve 14, whereby the free end of the first contact piece 241 and the free end of the planted pin portion of the second contact piece 242 contact each other when the free end of flexible hose 16 is mounted on the valve 14.

Returning now again to FIG. 1, the switches $S_2$ and switches $S_4$ for each of the burning systems C are also subsequently connected with one another and, further, output ends of the switch $S_2$ and switch $S_4$ in each burning system are connected with each other to form another circuit $CR_2$. A closed circuit is formed by switch $S_2$ in each of the pieces of gas burning equipment, when the valve 18 is closed and burning does not occur. A closed circuit is formed by switch $S_4$ in each of the pieces of gas burning equipment, when the valve 18 is opened and the burning does occur. Therefore, the circuit $CR_2$ forms an open circuit, only when, in one or more pieces of gas burning equipment, the valve 18 is opened but burning does not occur, thus detecting an abnormal non-burning of gas.

Each of the gas burning systems C may be detachably connected to the circuits $CR_1$ and $CR_2$ through a socket 32 which may be located at the gas valve 14 or on a wall near the valve 14. The switches $S_2$, $S_3$ and $S_4$ for each gas burning system C are incorporated into the circuits $CR_1$ and $CR_2$ as parts thereof by inserting a plug for the lastly arranged piece of gas burning equipment $F_3$ into the socket 32. The gas valves 14 of the lastly arranged piece of gas burning equipment $F_3$ are provided with switches $S_5$, $S_6$ which are closed when the gas valve 14 is closed, so that the circuits $CR_1$ and $CR_2$ are closed in such portions, if all of the gas valves are kept in the closed state. Namely, the switch $S_5$ and the switch $S_2$ in the gas burning equipment $F_3$ as well as the switch $S_6$ and the switch $S_3$ in gas burning equipment $F_3$ are, respectively, connected in parallel through the socket 32. Therefore, when the gas burning equipment $F_3$ is connected to the corresponding gas valve 14 through the flexible hose 16 and then the gas valve 14 is opened, the switches $S_2$, $S_3$ and $S_4$ in the corresponding gas burning system C are incorporated into and form the circuits $CR_1$ and $CR_2$, as referred to hereinbefore. The removal of the gas burning equipment $F_3$ causes the removal of the corresponding switches $S_2$, $S_3$ and $S_4$, but, in this case, the corresponding gas valve 14 is kept in a closed state to avoid breaking the circuits $CR_1$ and $CR_2$ by virtue of the switches $S_5$ and $S_6$. The structure of each of these said gas valves 14 may be of substantially the same as that disclosed and shown in connection with the valve 18 for each piece of gas burning equipment and thus further explanation and illustration thereof shall be omitted.

The control panel D comprises an electric source circuit having a plug 34 to be connected to an electric power source (not shown), a transformer 36 and a rectifier 38; a switch device 40 having a reed relay or switch $S_7$ which is normally closed but is opened when current flows through relay coil 401, an alarm member 42 which may be of a warning lamp or buzzer, relay 44 which has a relay coil 441, relay 46 which has a relay coil 461, a timer 48 and a pilot lamp 50. The control panel D serves to arrange detection signals from said circuits $CR_1$ and $CR_2$ to control the opening or closing of the circuit for actuating the solenoid $A_1$ of the electromagnetic valve A and the opening or closing of the circuit for operating the alarm member 42. In the control panel D, the symbols a and b, illustrate the contacts in the relays 44 and 46 and reference numeral 52 shows terminals for connecting a possible supplemental installation such as a vibration detector, a thermoswitch, device for measuring oxygen concentration or the like.

The electrical connections of elements or members shall be explained hereinafter with reference to FIG. 1. One end of the electrical source is connected to one end of the relay coil 401 and the alarm member 42 as well as, through the reed relay or switch $S_7$, to one terminal of the solenoid $A_4$, pilot lamp 50 and relay coils 441 and 461. The other end of the electrical source is connected to the second terminal of the pilot lamp 50, the a-side input terminals of the relays 44 and 46, one input terminal of the timer 48, the starting ends of the circuits $CR_1$ and $CR_2$ (input terminals for the switches $S_4$ and $S_2$ as well as the contacts 24' and switches $S_3$), as well as the input terminal of the reed relay or switch $S_1$.

The circuits $CR_1$ and $CR_2$ terminate at the second terminal of the relay coils 461 and 441, respectively. One a-side output terminal of the relay 46 is connected to the second terminal of the solenoid $A_4$ through the b-side terminals of the relay 44. One a-side output terminal of the relay 44 is connected to the second terminal of each of the alarm member 42 and relay coil 401. An output terminal of the reed relay or switch $S_1$ is connected to the second terminals of the alarm member 42 and relay coil 401.

The operation or function of the apparatus 10 according to the present invention will now be explained.

It is assumed that the electrical plug 34 is connected to an electrical source (not shown) by inserting the same into a power socket (not shown), that each of the flexible hoses 16 is mounted to safely connect to the corresponding valve 14 and valve 18 for the gas burning equipment $F_1$ to $F_3$, that each valve 18 is closed and that no gas has yet been consumed. In this state or condition, the circuit $CR_1$ comprising the switches $S_3$ as well as the circuit $CR_2$ comprising the switches $S_2$ and $S_4$ are kept in a closed state. Therefore, the relay coils 441 and 461 of the relays 44 and 46 are energized to open the a-side contacts and close the b-side contacts thereof and thus the solenoid $A_4$ is not energized keeping the electromagnet valve A in its closed state.

It is then assumed that the operator turns the finger lever of gas valve 18 for one of the pieces of gas burning equipment $F_1$–$F_3$, in order to ignite the gas. In this case, the opening of the valve 18 makes the circuit $CR_1$ open to de-excite the relay coil 461, close the a-side contacts of the relay 46 and energize the solenoid $A_4$, so that the electromagnetic valve A is opened to make the ignition of gas for the corresponding piece of gas burning equipment $F_1$, $F_2$ or $F_3$ possible. This explanation has been made under the assumption that the switch $S_4$ is closed simultaneously with the opening of the valve 18 but it takes usually several seconds from the opening of the valve 18 until the switch $S_4$ is closed. According to the embodiment of the present invention as shown in FIG. 1, the time lag can be accomodated by setting the timer 48. Therefore, the timer 48 is of a type having a property to pass current to the relay coil 441 for a predetermined time period (several seconds) simultaneously with the opening of the circuit $CR_1$. However, there is a possibility that the desired ignition for closing the switch $S_4$ can be carried out with use of gas remaining in the piping, even if the electromagnetic valve A is kept in a closed state. In this particular case, after ignition, the switch $S_4$ will be closed to open the electromagnetic valve A and thus the burning may be sustained without the use of any timer. In other words, the provision of the timer 48 is not essential for the apparatus 10 according to the invention. As long as the gas supplied for the gas burning equipment is normally consumed by burning, the circuit $CR_2$ is maintained in a closed state keeping the solenoid $A_4$ in an energized condition for maintaining the electromagnetic valve in an open state, whereby the burning can be maintained without fail.

If any gas leakage or escape should happen, the apparatus 10 operates automatically as follows. There are various causes of gas leakage and thus the following explanation shall be given on each of the causes.

Extinguished Flame

The ceasation of burning causes the burning sensitive member switch $S_4$ to open placing the circuit $CR_2$ in an open state. Therefore, the relay coil 441 is de-excited closing the a-side contact and opening b-side contact of relay 44 and thus the solenoid $A_4$ becomes de-excited to close the electromagnetic valve A, so that the gas supply is automatically shut off. Current flows to the alarm member 42 through the a-side contact of the relay 44 to issue a warning of the gas leakage. Further, through the a-side contact of relay 44, the current flows to the relay coil 401 opening the switch $S_7$ preventing current flow to all elements subsequent to the switch $S_7$.

Disconnecting of a Flexible Hose

The disconnection of one of the flexible hoses causes one of the contacts 24 or 24' to open the circuit $CR_2$. Therefore, the apparatus 10 behaves similarly to that previously stated in section above "Extinguished Flame".

Non-Burning in Gas Burning Equipment

In case burning of gas does not taken place in at least one of the pieces of gas burning equipment when the valve 18 for the corresponding gas burning equipment has been opened, the switches $S_4$ are kept in an open state also keeping the circuit $CR_2$ in an open state. This means the gas supply is shut down by the action of the electromagnetic valve A (see above section "Extinguished Flame").

In this connection, please note that, within the predetermined time period of the timer 48, the relay coil 441 will be excited to keep open the electromagnetic valve A but, thereafter, the coil is de-excited to close the valve. In other words, in this case, the gas escapes for only the few seconds of the predetermined set previously in the timer 48.

Disconnection of Gas Burning Equipment

When the gas valve 14 to which the gas burning equipment $F_3$ is connected is opened, the switches $S_5$, $S_6$ are opened to place the circuits $CR_1$ and $CR_2$ in an open state. In this case, therefore, the current flow for actuating the solenoid $A_4$ shall be shut off, if the gas burning equipment $F_3$ is not connected to the corresponding gas valve 14 through the corresponding flexible hose 16.

The opening or closing operation of the other gas valves 14 does not provide this function for the gas burning equipment $F_3$. Even if the corresponding flexible hose 16 is not connected or the flexible hose 16 is connected but the corresponding gas burning equipment is not connected, the gas leakage due to this cause will be prevented in the manner as stated in the section "Disconnection of a Flexible Hose" or "Non-Burning in Gas Burning Equipment".

Defect in Piping

In case a gas leakage occurs due to damage in any portion of the stationary pipe 12, the flexible hoses 16, the gas valves 14 or the valves 18 for the gas burning equipment, the gas pressure in the stationary pipe 12 or the flexible hoses 16 drops in a value below the predetermined level when no gas burning equipment is used causing the closure of the reed relay or switch $S_1$. This means that current flows to the alarm member 42 to issue a warning signal, so that one can confirm the defect in piping.

The invention has been explained hereinbefore in regard to particular embodiments but it is to be noted that the illustrated embodiments are mere examples and thus the invention should not be limited to such concrete embodiments, since many changes or modifications can easily be made by those skilled in the art in accordance with the spirit of the invention and within the scope of the claims.

What is claimed is:

1. An apparatus for preventing gas leakage from gas burning equipment, comprising:

a pipe means having one end connected securely to an outlet of a stationary gas supplying source pipe;

an electromagnetic valve means arranged in said pipe means for normally closing the gas passage in said pipe means and for opening the gas passage when an electrical signal is applied thereto;

a gas pressure detecting means mounted on said pipe means downstream of said electromagnetic valve means for detecting when the gas pressure in said pipe means is lower than a predetermined pressure;

a plurality of gas burning system, each of which is connected to the other end of said pipe means, each of said gas burning systems including a valve means for opening and closing the gas passage to said gas burning system, first and second switch means coupled to said valve means for closing said first and second switch means when said valve means is closed and opening said first and second switch means when said valve means is open, a flame detection means for detecting the presence of normal gas burning in said gas burning system and a third switch means coupled to said flame detection means for closing said third switch means when said flame detection means detects the presence of normal gas burning;

a first circuit means for connecting said first switch means of said gas burning systems in series;

a second circuit means for connecting said second and third switch means of each of said gas burning system in parallel with each other and for connecting said parallel connections of each of said gas burning system in series;

an alarm means for producing an alarm; and an electrical control system connected to said electromagnetic valve means, said gas pressure detecting means, said first and second circuit means and said alarm means, for applying an electrical signal to said electromagnetic valve means to open said gas passage when said first circuit means is open and said second circuit means is closed, for actuating said alarm means when said second circuit means is open and for actuating said alarm means when said gas pressure detecting means detects a gass pressure less than said predetermined pressure.

2. An apparatus as claimed in claim 1 further comprising a flexible hose associated with each of said gas burning systems for coupling said pipe means to said gas burning system and wherein said second circuit means further comprises contact means associated with each of said flexible hoses connected in series with said parallel connection of said second and third switch means of the corresponding gas burning system, for opening said second circuit means when said flexible hose is disconnected.

3. An apparatus as claimed in claim 1, wherein the lastly connected gas burning system is coupled to said pipe means through an additional valve means, said apparatus further comprising fourth and fifth switch means coupled to said additional valve means for closing said fourth and fifth switch means when said additional valve means is closed and for opening said fourth and fifth switch means when said additional valve means is open and wherein said first circuit means further comprises plug and socket means for connecting said fourth switch means in parallel to said first switch means of said lastly connected gas burning system and said second circuit means further comprises plug and socket means for connecting said fifth switch means in parallel to said parallel connection of said second and third switch means of said lastly connected gas burning system.

4. An apparatus as claimed in claim 1, wherein said first and second switch means are reed relays actuated by a magnet piece arranged in a finger lever portion of said valve means of said gas burning system.

5. An apparatus as claimed in claim 1, wherein said first and second switch means are pressure sensitive switches arranged downstream of said valve means of said gas burning system.

6. An apparatus as claimed in claim 1, wherein said flame detection means comprises a thermocouple.

7. An apparatus as claimed in claim 1, wherein said flame detection means comprises an electrode, a free end of which is inserted in a possible burning flame for actuation by the electrical variation due to the existence of a burning flame between said electrode and a burner of said gas burning system.

8. An apparatus as claimed in claim 1 wherein said electrical control system further comprises a timing switch means connected in parallel to said second circuit means for applying an electrical signal to said electromagnetic valve means to open said valve means for a predetermined period after the opening of said first circuit, whereby said electromagnetic valve means is open from the time said valve means of one of said gas burning systems is opened until said flame detecting means of said one of said gas burning system would detect the presence of normal gas burning during a normal ignition sequence.

* * * * *